US009078524B2

(12) United States Patent
Bullard

(10) Patent No.: US 9,078,524 B2
(45) Date of Patent: Jul. 14, 2015

(54) WEB STRAP ATTACHMENT TO METAL FRAME

(71) Applicant: L&P Property Management Company, South Gate, CA (US)

(72) Inventor: Larry I. Bullard, Winston-Salem, NC (US)

(73) Assignee: L&P Property Management Company, South Gate, CA (US)

( * ) Notice: Subject to any disclaimer, the term of this patent is extended or adjusted under 35 U.S.C. 154(b) by 40 days.

(21) Appl. No.: 14/081,098

(22) Filed: Nov. 15, 2013

(65) Prior Publication Data

US 2015/0137576 A1 May 21, 2015

(51) Int. Cl.
*A47C 7/22* (2006.01)
*A47C 3/00* (2006.01)

(52) U.S. Cl.
CPC .... *A47C 7/22* (2013.01); *A47C 3/00* (2013.01)

(58) Field of Classification Search
CPC ..... A47C 5/06; A47C 7/405
USPC ..... 297/452.63, 440.11
See application file for complete search history.

(56) References Cited

U.S. PATENT DOCUMENTS

| | | | | |
|---|---|---|---|---|
| 2,667,916 | A * | 2/1954 | Burd | 297/448.1 |
| 2,856,663 | A | 10/1958 | Elsner | |
| 3,039,763 | A * | 6/1962 | Staples et al. | 267/107 |
| 3,375,861 | A | 4/1968 | Marlow | |
| 4,047,824 | A | 9/1977 | Brokmann et al. | |
| 6,081,975 | A | 7/2000 | Norrby | |
| 6,116,694 | A | 9/2000 | Bullard | |
| 6,263,573 | B1 | 7/2001 | Bullard | |
| 7,739,775 | B2 | 6/2010 | Shimanski | |
| 7,946,014 | B2 | 5/2011 | Tornero | |
| 8,387,217 | B1 | 3/2013 | Hinds et al. | |
| 2005/0200189 | A1 * | 9/2005 | Schultz et al. | 297/452.56 |

* cited by examiner

*Primary Examiner* — David R Dunn
*Assistant Examiner* — Jody Giacoman
(74) *Attorney, Agent, or Firm* — Wood, Herron & Evans, LLP

(57) ABSTRACT

A seating product is provided which comprises a metal frame, straps of webbing joined to the metal frame with wire hooks. Each of the wire hooks has a main portion inside a loop created in the strap of webbing and two L-shaped portions extending through openings in the metal frame. Each of the L-shaped portions reduces movement of the wire hooks inside the metal frame reducing noise and wear. The metal frame is made of two pieces joined together, one of the pieces being straight and the other being generally U-shaped.

23 Claims, 6 Drawing Sheets

WEB STRAP ATTACHMENT TO METAL FRAME

FIELD OF THE INVENTION

The present invention relates generally to furniture products and, more particularly, to seating products.

BACKGROUND OF THE INVENTION

Webbing is commonly attached to a furniture frame member by hand. The webbing is typically attached to one side of a wooden frame by staples. The user then stretches the webbing across the frame and staples it to the other side of the wooden frame. This step is repeated for the desired number of pieces of webbing to be attached to the wooden frame. This process is slow and time consuming. Further, the process does not provide consistent tension of the webbings across the frame. Still further, the process does not provide consistent spacing between the webbings without hand measurement.

Sometimes steel frames are used in seating applications with elastomeric webbing for strength and durability purposes. In certain applications, such as the contract and medical seating industries, a seating structure must be durable enough to pass stringent cycle and drop tests, such as the ANSI/BIFMA X5.1 Office Chair Test or the ANSI/BIFMA X5.4 Lounge and Public Seating Test. For purposes of passing these tests, traditional methods of attaching a strap of webbing to a steel frame have proven to be a weakness in terms of cost and/or durability.

One type of known method of attaching webbing to steel frames is to sew the webbing into a large loop, which would then be stretched over the width or depth of the steel frame. This method requires twice the length of webbing as other methods, which can make it cost-prohibitive.

A more common method has been to attach a strip of webbing to a wire hook, which is then engaged in a hole in the steel frame. The webbing can be sewn to itself around the wire hook or clamped by a sleeve or collar. Most of these wire hooks are shaped like a coat hanger, comprising a flat section passing through the end loop of the webbing, with the two ends bending around the end of the webbing, coming back together in the center to form a triangular shape, then bending back together to form a hook to engage a single hole in the metal frame. This type of attachment hook has created problems in testing. One such problem is when the webbing is only attached to the wire hook by a clamping collar, the impact loads of the cycle or drop test can cause the webbing to slip through the collar, causing a significant or complete loss of support from the webbing. Another problem is when the webbing is secured to the wire hook via a sewn seam, without the clamping collar, then the flat part of the hook can deform under the impact loads of the cycle or drop test, causing a loss of support due to the change in the effective elongation of the webbing. Another problem is when the webbing or strap is sewn to itself around the flat section of the wire hook and the clamping collar is added, the flat section of the wire hook is reinforced, so the slippage and bending problems may be reduced. However, the wire hooks are still prone to breakage during cycle testing, typically in the bends where the wire emerges from the end loop of the webbing.

Consequently, there is a need for a wire hook for use with webbing for seating products which may be used in the end loops of the webbing and requires less wire than known wire hooks.

Further, there is a need for a wire hook for use with webbing for seating products which eliminates movement of the wire hooks in the holes and therefore, eliminates noise and wear.

SUMMARY OF THE INVENTION

One objective of the present invention is to create an effective durable method of attaching straps of elastomeric webbing to a steel seat frame of a seat assembly. Another objective is to reduce the costs of manufacturing wire hooks for attaching straps of elastomeric webbing to a steel seat frame of a seat assembly.

According to one embodiment of the present invention, a seating product comprises a generally rectangular metal frame having four sides, a plurality of webbing straps and wire hooks for attaching opposed ends of each webbing strap to opposed sides of the metal frame. The metal frame may be any number of pieces including one continuous piece. However, in one preferred embodiment, the metal frame comprises two pieces welded together, one linear piece and one generally U-shaped piece. The linear piece has an L-shaped cross-section. The generally U-shaped piece has a generally rectangular shaped cross-section with a hollow interior.

Each strap of webbing comprises a flexible piece of elastomeric material having an end loop at each end. A wire hook extends through each of the end loops for securing opposed ends of each strap to the metal frame. The straps of webbing may be made of woven or non-woven materials. In one embodiment, each strap of webbing has a width of two inches. However, the straps may be of any desired width.

Each of the wire hooks is preferably made of one piece of wire, but may be made of multiple pieces of wire. Each wire hook has a straight main portion inside one of the end loops of one of the straps of webbing. Each of the wire hooks further comprises two L-shaped portions, each of the L-shaped portions comprising a downwardly extending connecting portion and an end portion extending generally perpendicular to the connecting portion. Upon assembly, the connecting portion extends through an opening through the top wall of one of the sides of the metal frame, and the end portion of the wire hook contacts the metal frame.

These and other objects and advantages of the present invention will be apparent from the following detailed description of the embodiments which are illustrated in the drawings, in which:

DETAILED DESCRIPTION OF THE DRAWINGS

Figure 1:
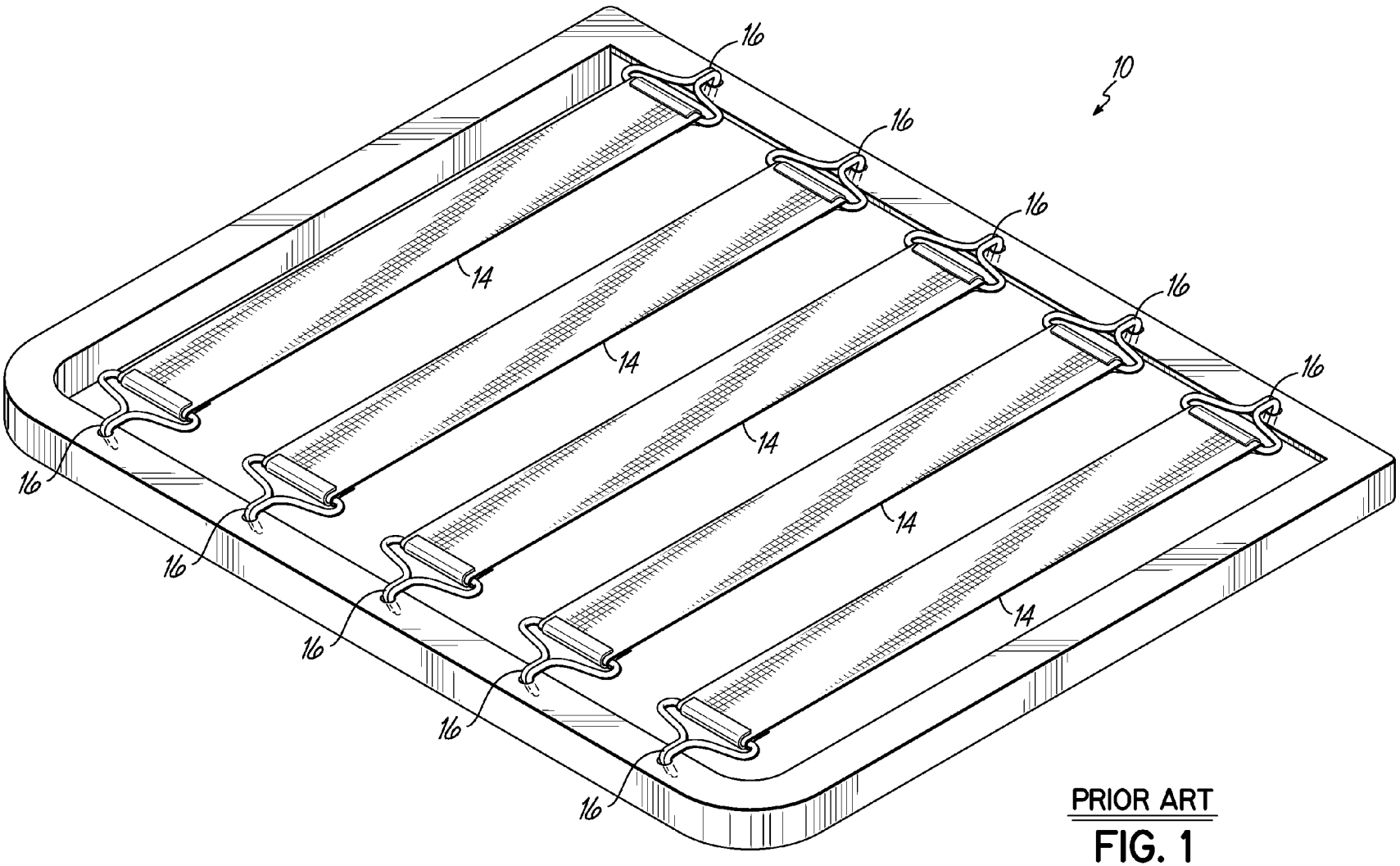
PRIOR ART FIG. 1
FIG. 1 is a perspective view of a portion of a prior art seating product.

Referring to the drawings, and particularly to FIG. 1, a prior art seating assembly 10 is illustrated. The prior art assembly 10 is shown comprising a generally rectangular frame 12 and a plurality of straps of webbing 14 secured to each other with wire hooks 16 shaped like coat hangers. Such prior art wire hooks 16 have proven unsuccessful in passing cycle and drop tests. Such wire hooks are prone to breakage in its bends and use more wire than the wire hooks of the present invention. Another drawback to these prior art wire hooks 16 is that they may directly contact foam or other cushioning materials (not shown) applied to an upper surface of the seat assembly 10 and, over time may deteriorate these cushioning or padding materials. Another drawback to this type of prior art wire hook 16 is its torsional instability due to the wire hook being secured in one hole in the frame 12. Due to the torsional instability of the straps of webbing 14, the resultant prior art seating product may not be as comfortable and durable as seating products using the wire hooks of the present invention.

Figure 2:
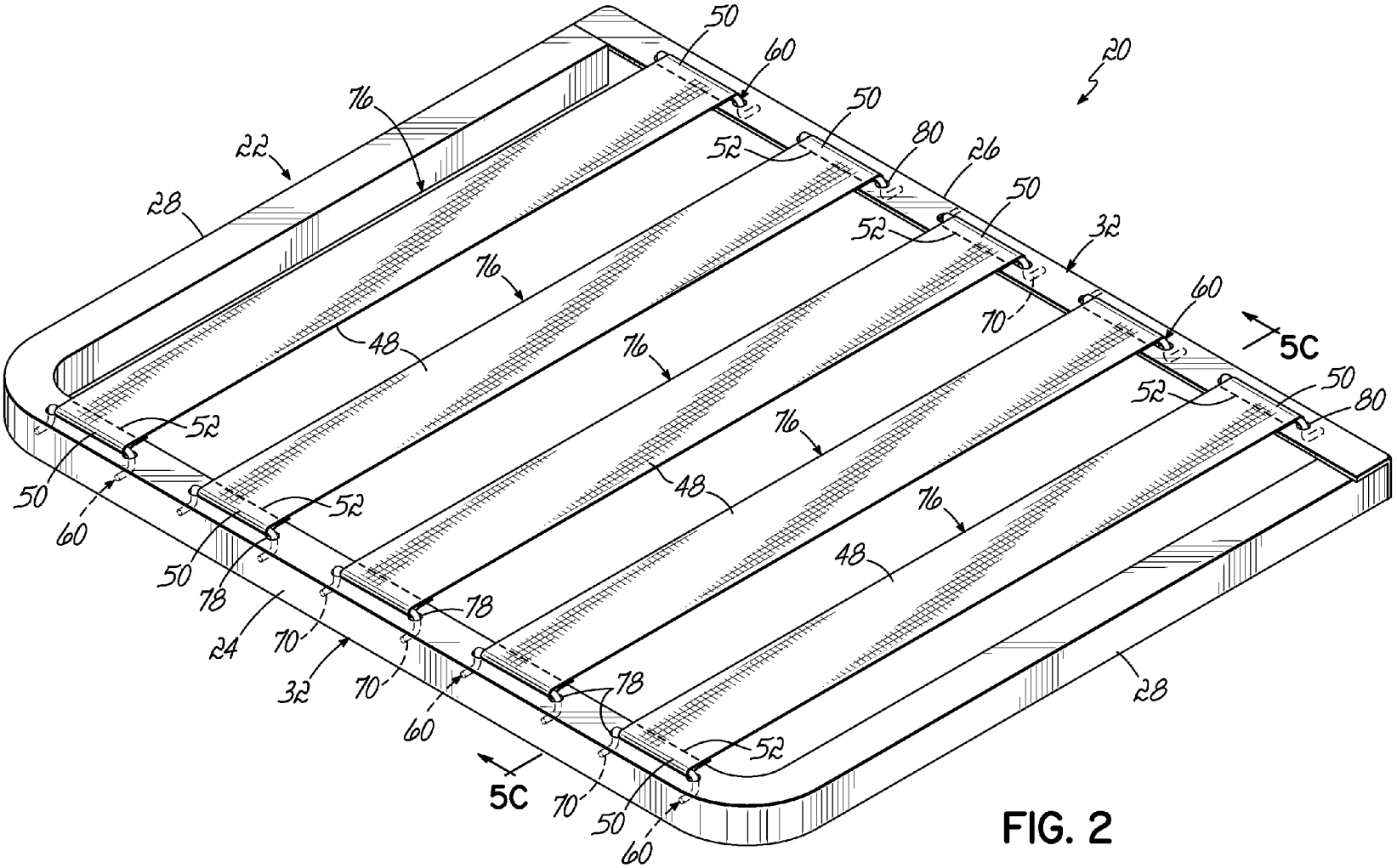
FIG. 2 is a perspective view, partially broken away, of the seating product of the present invention.

FIG. 2 illustrates a portion of a seating product 20 made in accordance with the present invention. The seating product 20 may comprise either a seat section or a back section of a seating product or any other component of furniture. The seating product 20 comprises a generally rectangular metal frame 22 having four sides, a front 24, a rear 26 and two opposed sides 28. In the illustrated embodiment, the frame 22 comprises two pieces, a generally U-shaped piece 30 and a linear rear piece 32 welded together. The generally U-shaped piece 30 comprises the front 24 and two sides 28 of the metal frame 22. The linear rear piece 32 comprises the rear 26 of the metal frame 22.

Figure 4:
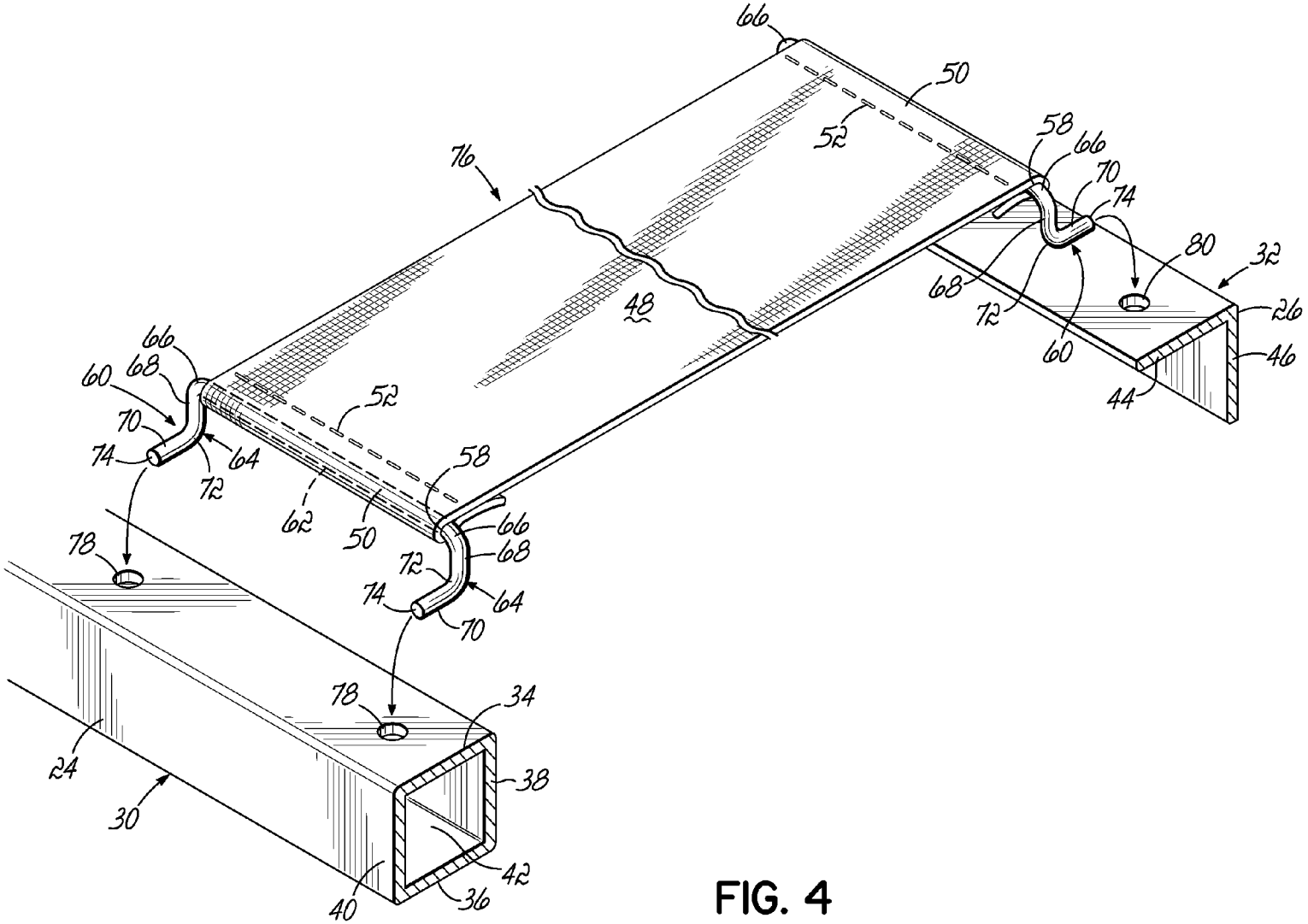
FIG. 4 is a perspective view, partially broken away, of one of the straps of webbing of the seating product being secured to a metal frame.

As best shown in FIG. 4, the generally U-shaped front piece 30 has a generally rectangular cross-section comprising a top wall 34, a bottom wall 36, an inner wall 38 and an outer wall 40 defining a hollow interior 42. As shown in FIG. 4, the linear rear frame piece 32 is generally L-shaped in cross-section, having a top wall 44 and a side wall 46 extending downwardly from an outer edge of the top wall 44.

Figure 3:
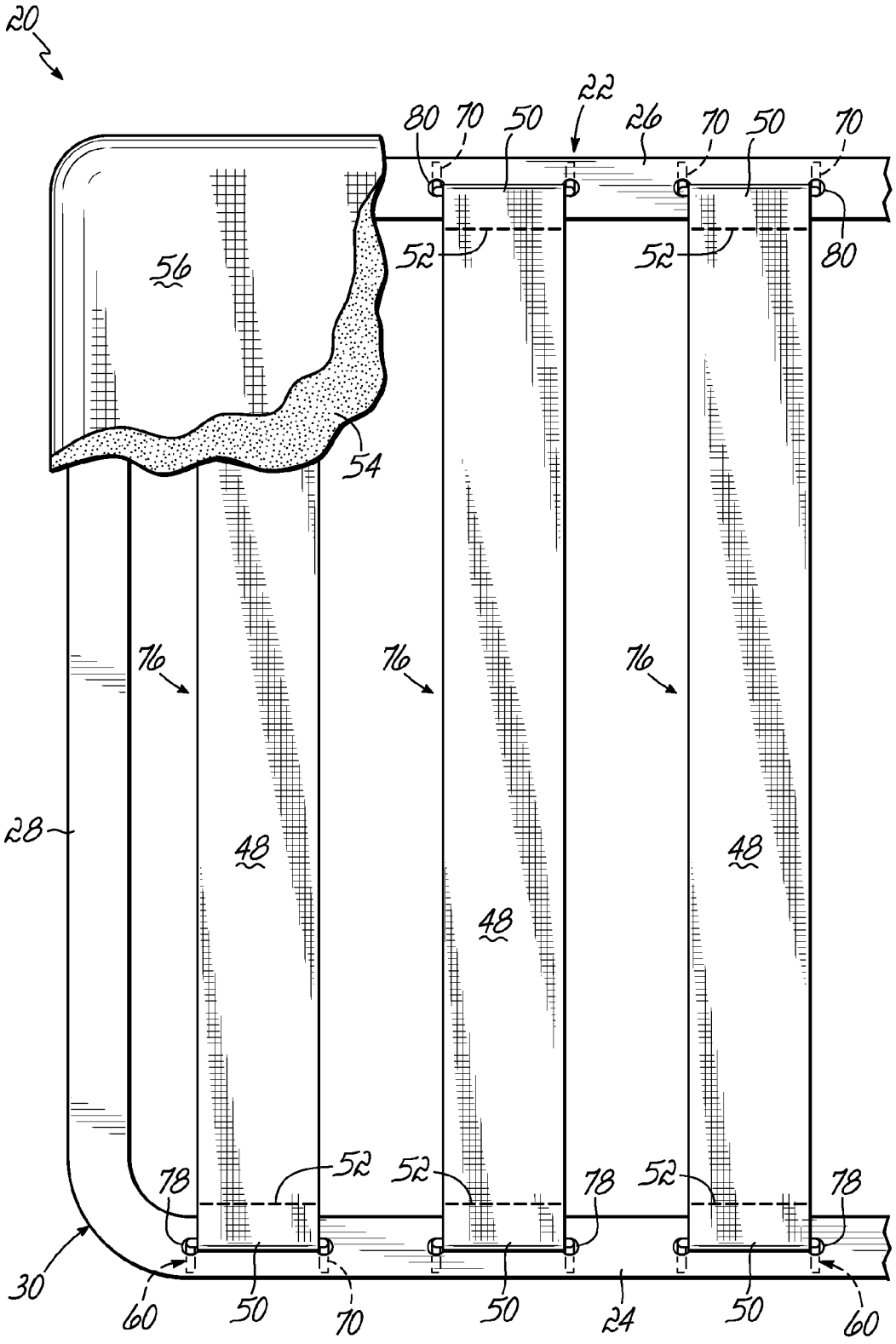
FIG. 3 is a top view, partially broken away, of the seating product of FIG. 2.

As best shown in FIGS. 2 and 3, seating product 20 further comprises a plurality of straps of webbing 48. Each strap of webbing 48 has opposed end loops 50, each end loop 50 being created by sewing or otherwise securing the strap of webbing to itself along a seam 52. Although the drawings illustrate five straps of webbing 48, any number of webbing straps of any desired width or length may be used in accordance with the present invention. A wire hook 60 passes through each of the end loops 50 and secures one end of one of the webbing straps 48 to the metal frame 22.

As shown in FIG. 3, one or more layers of padding 54, such as foam or other cushioning materials, may cover one or more surfaces of the seating product. An upholstered covering 56 encases or surrounds the metal frame 22, straps of webbing 48, wire hooks 60 and padding 54.

As best shown in FIG. 4, each wire hook 60 has a linear main portion 62, which extends through the interior 58 of one of the end loops 50 at the end of the one of the straps of webbing 48. Each wire hook 60 further comprises two L-shaped portions 64, each L-shaped portion 64 extending outwardly from one of the opposed ends of the main portion 62 of the wire hook 60 at location 66. Each L-shaped portion 64 comprises a connecting portion 68 extending downwardly from curved location 66 and extending generally perpendicular to linear main portion 62. Each L-shaped portion 64 further comprises an end portion 70 extending generally perpendicular to connecting portion 68. The end portion 70 begins at curved location 72 and terminates at end 74.

Figure 5A:
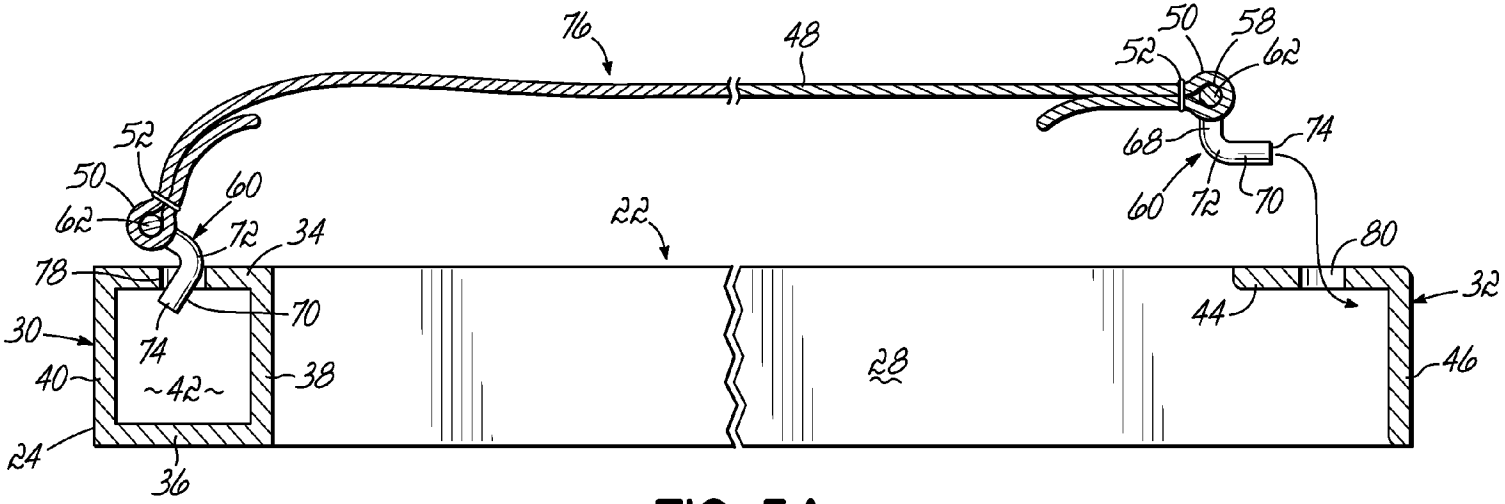
FIG. 5A is a side elevational view of one of the straps of webbing of the seating product being secured to a metal frame.
Figure 5B:
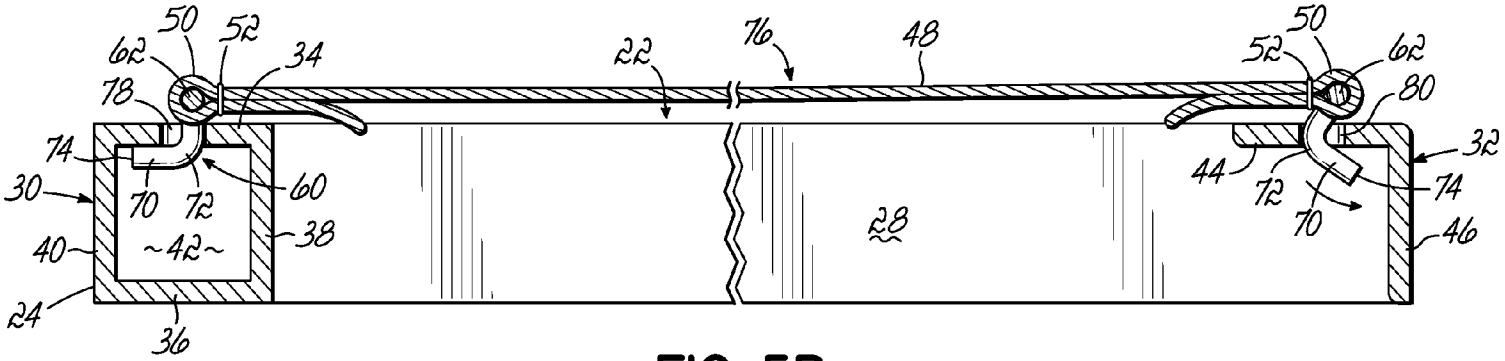
FIG. 5B is a side elevational view of the strap of webbing of FIG. 5A being further secured to the metal frame.
Figure 5C:
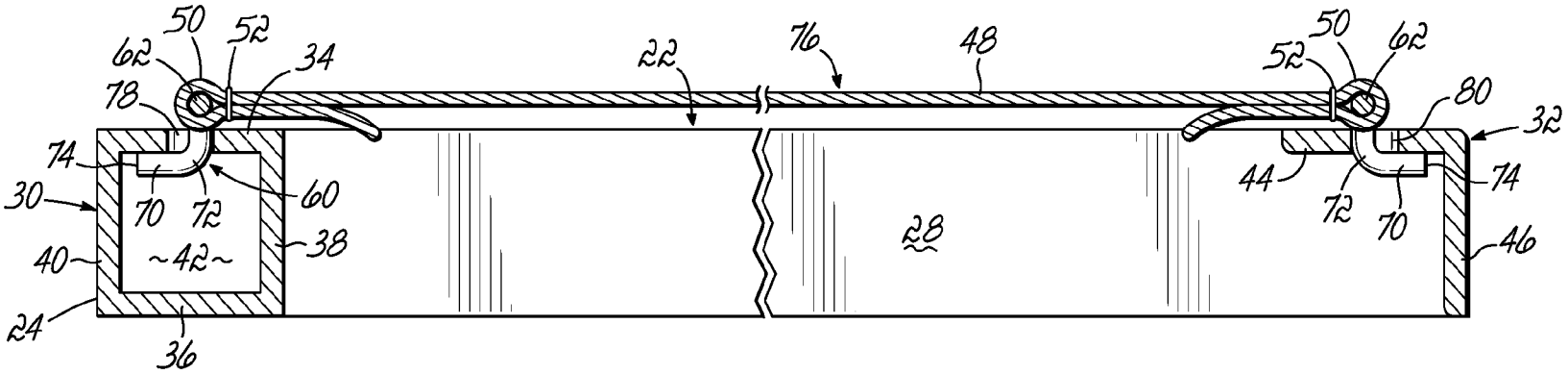
FIG. 5C is a cross-sectional view along the line 5C-5C of FIG. 2.

For purposes of this document, a strap of webbing 48 and two wire hooks 60 are considered a strap assembly 76. FIGS. 4 and 5A-5C illustrate the method of securing one of the strap assemblies 76 to the steel frame 22 of seating product 20. As shown in FIGS. 4 and 5A, one of the wire hooks 60 is inserted into two spaced openings 78, each of the openings 78 extending through the top or upper wall 34 of the front 24 of the generally U-shaped front piece 30 of steel frame 22. More particularly, the L-shaped portions 64 are passed through the spaced openings 78, such that the end portions 70 move from a generally vertical orientation to a generally horizontal orientation underneath the upper wall 34 of the front 24 of the generally U-shaped front piece 30 of steel frame 22, as shown in FIGS. 5B and 5C. In the positions shown in FIGS. 5B and 5C, each of the end portions 70 of each of the L-shaped portions 64 contact the upper wall 34 of the front 24 of the generally U-shaped front piece 30 of steel frame 22 and are generally parallel to each other.

As shown in FIG. 5B, once the L-shaped portions 64 are secured in place relative to the upper wall 34 of the front 24 of the generally U-shaped front piece 30 of steel frame 22, the strap of webbing 48 is stretched from a relaxed condition to a stretched condition. The L-shaped portions 64 at the opposite end of the strap assembly 76 are then inserted into two openings 80 through the upper wall 44 of the linear rear frame piece 32, as shown in FIG. 4. More particularly, the L-shaped portions 64 are passed through the spaced openings 80, such that the end portions 70 move from a generally vertical orientation to a generally horizontal orientation underneath the upper wall 44 of the linear rear frame piece 32 of steel frame 22, as shown in FIGS. 5B and 5C. In the positions shown in FIGS. 5B and 5C, each of the end portions 70 of each of the L-shaped portions 64 contact the upper wall 44 of the linear rear frame piece 32 of steel frame 22 and are generally parallel to each other.

Once the wire hook 60 is engaged with the openings or holes 78 in the front 24 of the generally U-shaped front piece 30 of steel frame 22, the strap of webbing 48 is stretched toward the other side of the steel frame 22 and the other wire hook 60 of web assembly 76 and engaged with the upper wall 44 of the linear rear frame piece 32 of steel frame 22, the tension created by the strap of webbing 48 locks the wire hooks 60 into position. There is no movement of the wire hooks 60 in the openings, thereby eliminating noise and wear. There is no extra wire, nor extra bends, that can lead to deformation of the main section of the wire hook, thereby eliminating the need for collars. There is no part of the wire hook that is directly in contact with the padding or cushioning materials that may be applied to make an upholstered seat, eliminating a source of deterioration of the padding or cushioning materials.

Although the strap assemblies 76 are illustrated extending from front-to-back, those skilled in the art will appreciate that the strap assemblies 76 may extend from side-to-side. For example, openings and/or holes may be in opposed sides of a generally U-shaped piece of a steel frame with the strap assemblies extending therebetween. This document is not intended to limit the orientation of the frame and/or strap assemblies to those illustrated.

Although only certain exemplary embodiments of this invention have been described in detail above, those skilled in the art will readily appreciate that various modifications can be made without departing from the principles of the present invention. Accordingly, all such modifications are intended to be included within the scope of this invention.

What is claimed is:

1. A seating product comprising:

a metal frame having four sides, two opposed sides of the frame each having a plurality of pairs of spaced openings extending through a top wall of the frame;

a strap of webbing having two end loops;

a wire hook extending through each of the end loops wherein each of the wire hooks has a main portion inside one of the end loops of the strap of webbing and two L-shaped portions, each of the L-shaped portions comprising a downwardly extending connecting portion and an end portion extending generally perpendicular to the connecting portion, wherein one of the L-shaped portions of the wire hook extends through one of the openings of one of the pairs of openings and the other of the L-shaped portions of the wire hook extends through the other opening of the pair of openings.

2. The product of claim 1 wherein the end portions of each of the wire hooks contact the metal frame.

3. The product of claim 1 wherein each of the wire hooks comprises one piece of metal.

4. The product of claim 1 wherein the end portions of each of the wire hooks contact an upper wall of one side of the metal frame.

5. The product of claim 1 wherein the strap of webbing is a woven material.

6. The product of claim 1 wherein the strap of webbing is two inches in width.

7. The product of claim 1 wherein the metal frame comprises multiple pieces.

8. The product of claim 7 wherein the metal frame comprises two pieces.

9. The product of claim 8 wherein one of the pieces is generally U-shaped.

10. The product of claim 1 wherein the strap of webbing is elastomeric.

11. A seating product comprising:

a metal frame having opposed sides;

multiple straps of elastomeric webbing, each strap of elastomeric webbing having two end loops;

a wire hook extending through each of the end loops wherein each of the wire hooks has a portion inside one of the end loops of the strap of webbing and two L-shaped portions, each of the L-shaped portions comprising a downwardly extending connecting portion extending through its own separate opening through the top wall of one of the sides of the metal frame and an end portion extending generally perpendicular to the connecting portion.

12. The product of claim 11 wherein the end portions of each of the wire hooks contact the metal frame.

13. The product of claim 11 wherein each of the wire hooks comprises one piece of metal.

14. The product of claim 11 wherein the end portions of each of the wire hooks contact an upper wall of one side of the metal frame.

15. The product of claim 11 wherein each strap of webbing is a woven material.

16. The product of claim 11 wherein each strap of webbing is two inches in width.

17. The product of claim 11 wherein the metal frame comprises multiple pieces.

18. The product of claim 17 wherein one of the pieces is made of angle iron.

19. The product of claim 17 wherein one of the pieces is generally U-shaped.

20. The product of claim 19 wherein the U-shaped piece has a hollow interior.

21. A seating product comprising:

a metal frame having two opposed sides, each side of the frame having a pair of openings extending through a wall of the frame;

a strap of webbing having two end loops;

a wire hook extending through each of the end loops, each of the wire hooks having a portion inside one of the end loops of the strap of webbing and two L-shaped portions, one of the L-shaped portions comprising a downwardly extending connecting portion extending through one of the pair of openings and an end portion extending generally perpendicular to the connecting portion and the other L-shaped portion of the wire hook comprising a downwardly extending connecting portion extending through the other opening of the pair of openings and an end portion extending generally perpendicular to the connecting portion.

22. The product of claim 20 wherein the end portion of each L-shaped portion of each wire hook contacts the metal frame.

23. The product of claim 20 wherein each of the wire hooks comprises one piece of metal.

* * * * *